United States Patent [19]

LeVine

[11] Patent Number: 4,512,112

[45] **Date of Patent: * Apr. 23, 1985**

[54] KNIFE SHARPENER CLAMP CONSTRUCTION

[76] Inventor: Arthur L. LeVine, P.O. Box 800, Williamsville, N.Y. 14221

[ * ] Notice: The portion of the term of this patent subsequent to Sep. 18, 1984 has been disclaimed.

[21] Appl. No.: 432,702

[22] Filed: Oct. 4, 1982

[51] Int. Cl.[3] ..... B24B 3/54; B21K 5/12; B25B 3/00

[52] U.S. Cl. ..... 51/221 BS; 51/69; 269/3

[58] Field of Search ..... 51/221 BS, 221 R, 217 P, 51/217 A, 217 R, 170, 69, 166 TS; 269/3; 76/82, 82.2, 88; 16/114 R

[56] References Cited

U.S. PATENT DOCUMENTS

| | | | |
|---|---|---|---|
| 27,413 | 3/1860 | Stokes | 76/86 |
| 93,031 | 7/1869 | Zimmerman . | |
| 308,046 | 11/1884 | Williams . | |
| 709,603 | 9/1902 | Larsen | 16/114 |
| 905,331 | 12/1908 | Larsen et al. . | |
| 945,771 | 1/1910 | Ensminger . | |
| 1,148,303 | 7/1915 | Farrar . | |
| 1,368,218 | 2/1921 | Chenette . | |
| 1,601,339 | 9/1926 | Ballou . | |
| 1,681,763 | 8/1928 | Eaton . | |
| 1,806,234 | 5/1931 | Boyd . | |
| 1,832,968 | 11/1931 | DeArmey . | |
| 2,012,513 | 8/1935 | Maze . | |
| 2,082,755 | 6/1937 | Polney . | |
| 2,116,343 | 5/1938 | Davis . | |
| 2,157,816 | 5/1939 | Carosi . | |
| 2,536,279 | 1/1951 | Grube . | |
| 2,586,636 | 2/1952 | Fischer et al. . | |
| 2,731,863 | 1/1956 | Bellows . | |
| 3,149,506 | 9/1964 | Heinmiller | 76/86 |
| 3,819,170 | 6/1974 | Longbrake . | |
| 4,320,892 | 3/1982 | Longbrake . | |

FOREIGN PATENT DOCUMENTS

| | | | |
|---|---|---|---|
| 83275 | 1/1954 | Norway | 51/69 |

*Primary Examiner*—Frederick R. Schmidt
*Assistant Examiner*—Robert A. Rose
*Attorney, Agent, or Firm*—Joseph P. Gastel

[57] ABSTRACT

A knife sharpener clamp including first and second mirror image counterpart clamp members each having an integral guide member of the same width as the clamp member, a plurality of apertures in each guide member for receiving a guide rod of a sharpener stone holder which carries a sharpening stone, and post receiving bores in the clamp members for selectively receiving the end of a post having concave recesses therein for accommodating the fingers of a person.

9 Claims, 5 Drawing Figures

KNIFE SHARPENER CLAMP CONSTRUCTION

BACKGROUND OF THE INVENTION

The present invention relates to an improved knife sharpener clamp construction.

By way of background, sharpeners of the type shown in U.S. Pat. Nos 3,819,170 and 4,320,892 are known. In sharpeners of this type, a knife blade is clamped between two clamp members and a sharpening stone is guided along the edge of a blade by a rod member secured to a sharpener stone holder and guided through an aperture in an upstanding guide member. However, the prior art sharpener clamp of U.S. Pat. No. 4,320,892 was deficient in a plurality of respects. Firstly, it included two clamp members each having separate upstanding guide members secured thereto by screws. This construction was expensive because the clamp and guide portions consisted of six separate parts which had to be assembled, and in use the parts sometimes tended to loosen and shift, thus interfering with the sharpening operation. Secondly, the upstanding guide members were relatively flimsy and therefore could not be grasped without bending when the clamp was being held during a knife sharpening operation. It is with overcoming the foregoing deficiencies of prior art types of devices that the present invention is concerned.

SUMMARY OF THE INVENTION

It is accordingly one object of the present invention to provide an improved knife sharpener in which relatively long blades can be sharpened because of the fact that the knife sharpener stone is capable of being moved in a relatively large lateral sweep lengthwise of the blade.

Another object of the present invention is to provide an improved knife sharpener clamp which can be securely grasped to provide extremely good control during a knife sharpening operation.

A still further object of the present invention is to provide an improved knife sharpener clamp construction which can be grasped with equal facility by either the right or the left hand and which will provide all of the advantages in either event.

A further object of the present invention is to provide an improved knife sharpener clamp having integral clamp member and guide constructions which lessen the manufacturing cost and increase the reliability of the structure.

Yet another object of the present invention is to provide an improved knife sharpener clamp in which the integral guide members on the clamp members are relatively wide and their connections to the clamp members are also relatively wide so as to give the sharpener clamp great strength. Other objects and attendant advantages of the present invention will readily be perceived hereafter.

The present invention relates to a sharpener clamp construction comprising first and second clamp members having a first longitudinal axis and first and second ends, respectively, first and second jaws at said first ends of said first and second clamp members, respectively, for clamping a knife with a second longitudinal axis extending transversely to said first longitudinal axis, first and second guide member means formed integrally with and extending outwardly from said first and second clamp members, respectively, at said second end, and a plurality of apertures in said first and second guide member means at different distances from said second end for receiving a guide rod attached to a sharpener stone holder.

The various aspects of the present invention will be more fully understood when the following portions of the specification are read in conjunction with the accompanying drawings wherein:

DESCRIPTION OF THE PREFERRED EMBODIMENTS

Figures 1, 2, 3, 4, 5:
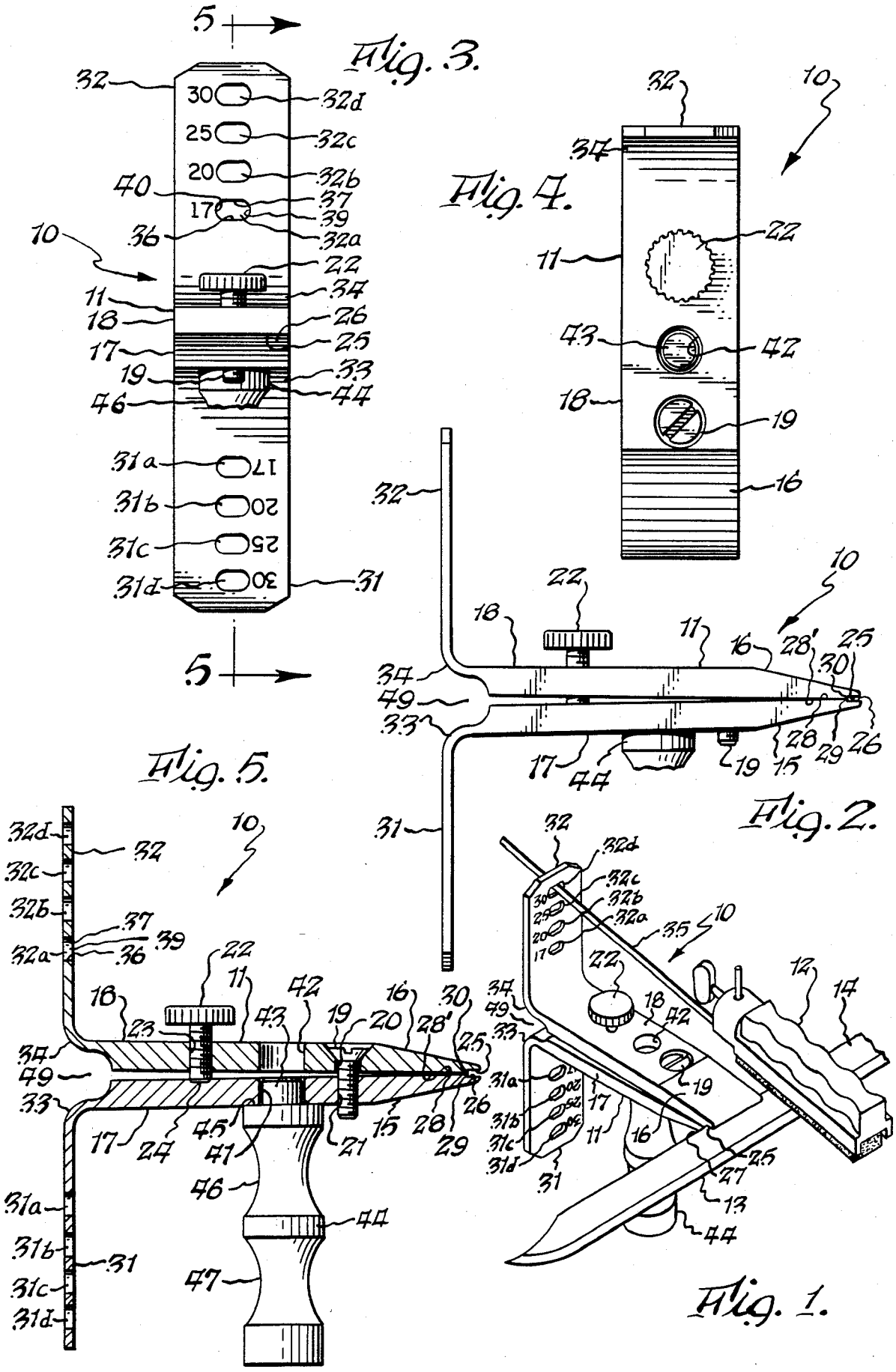
FIG. 1 is a perspective view of the improved clamp and a sharpener stone holder operable therewith.
FIG. 2 is a side elevational view of the clamp of FIG. 1.
FIG. 3 is an end elevational view of an improved clamp.
FIG. 4 is a plan view of the clamp of FIG. 1.
FIG. 5 is a cross sectional view taken substantially along line 5—5 of FIG. 3.

The sharpener 10 includes a knife clamp 11 and a sharpener stone holder 12 carrying a sharpening stone which is operative to sharpen the edge 13 of a knife 14 which is held between jaws 15 and 16 of clamp members 17 and 18, respectively, which are secured to each other by means of a screw 19 which extends through an aperture 20 in clamp member 18 and is threadably received in tapped bore 21 of clamp member 17. A thumb screw 22 is threadably received in tapped bore 23 of clamp member 18 and the end of thumb screw 22 bears against the surface of clamp member 17 and is received in dimple or complementary depression 24 to prevent sidewise movement of clamp members 17 and 18 relative to each other.

In order to secure a knife 14 within jaws 15 and 16 of clamp 11, screw 19 is backed off sufficiently so that the space between surfaces 25 and 26 of jaws 16 and 15, respectively, receives the rear edge portion 27 of blade 14 with a reasonably tight fit, and thereafter thumb screw 22 is manipulated to force clamp members 17 and 18 away from each other in the area of thumb screw 22 so that the jaws 15 will tightly clamp the rear edge 27 of knife 14 therebetween. The very outer edge portion of edge 27 will rest against surfaces 29 and 30 of jaws 15 and 16, respectively. The blade of the knife may also be clamped directly between the surfaces 28 and 28' of jaws 15 and 16, respectively.

In accordance with the present invention, a pair of guide members 31 and 32 are formed integrally with and extend outwardly from clamp members 17 and 18, respectively. The integral clamp and guide members 18–32 and 17–31 are essentially formed from angles having the cross sectional profile shown in FIGS. 2 and 5. The clamp members 17 and 18 are relatively thick as compared to the guide members 31 and 32. The guide members 31 and 32 merge into the ends of clamp members at curved portions 33 and 34, respectively, and as can be seen from FIGS. 3 and 4, curved portions 33 and 34 extend for the entire width of both the clamp members and the guide members, thereby providing an extremely stable structure. Furthermore, as can readily be seen from FIG. 2, the combined clamp and guide member 17–31 consists of only a single part whereas the analogous structure of the prior art consisted of three parts, namely, a clamp member, such as 17 without an integral guide member, a separate guide member, and a screw to hold them together. A prior art device is shown in FIGS. 1 and 2 of U.S. Pat. No. 4,320,892. Thus, the two clamp-guide members of the prior art included six separate parts whereas the two clamp-guide members of the present device consist of only two parts.

Guide member 31 includes a plurality of elongated apertures 31*a*, 31*b*, 31*c* and 31*d* which receive a guide rod, such as 35 of FIG. 1. Guide member 32 includes a plurality of corresponding elongated apertures 32*a*, 32*b*, 32*c* and 32*d*. Because guide members 31 and 32 are substantially wider than analogous guide members of the prior art, the elongated apertures therein can be longer so as to permit a wider sweep of the sharpener stone holder 12. Apertures 31*a* through 31*d* and 32*a* through 32*d* essentially have straight upper and lower sides and rounded ends. More specifically, aperture 32*a* includes straight lower and upper sides 36 and 37, respectively, and rounded ends 39 and 40. All of the other apertures are identical. The elongated aperture sides 36 and 37 can be of any desired length so as to permit the sharpener stone holder 12 to provide a desired range of operation when the guide rod has been inserted through the proper aperture and the sharpening stone is caused to laterally traverse the knife edge. This procedure is fully described in copending application Ser. No. 325,758, filed Nov. 30, 1981, now U.S. Pat. No. 4,471,951. The numerals on guide members 31 and 32 to the side of each aperture designate the approximate angle which the sharpener stone (not numbered) will make with the edge of the knife being sharpened. Preferably each clamp member-guide member 17–31 and 18–32 may be fabricated from an aluminum extrusion which is merely cut to the desired width.

Integral guide members 31 and 32 are of substantially the same width as clamp members 17 and 18, respectively, and curved portions 33 and 34, respectively. This construction provides great strength to the combined members 17–31 and 18–32, especially a great resistance against bending of the guide members relative to the attached clamp members when the sharpener is held, as described hereafter.

Bores 41 and 42 are provided in clamp members 17 and 18, respectively, to receive, with a snug fit, a cylindrical reduced end portion or pin 43 of post 44 having an annular shoulder 45 which supports the underside of clamp member 17. Post 44 includes a plurality of reduced concave portions 46 and 47 which are in the nature of solids of revolution, for receiving the thumb or fingers of a person. In this respect, a person can place his thumb in concave portion 46 and grasp guide member 31 with his fingers preferably with the third joint of the index finger resting in recess 49. Another way of holding the sharpener is to wrap the index and third fingers around concave portions 46 and 47, and cause the guide member 31 to bear against the palm of the hand below the thumb, and cause the thumb to bear against member 31, curved portions 33 and 34, and possibly along the rear side of guide member 32 below the hole which is used to receive the guide rod. By the use of a post, such as 44, in the above described manner a person can hold the sharpener in an entirely stable manner during the sharpening operation.

It will be appreciated that after one edge of a knife is sharpened when post 44 is inserted in bore 41 and guide member 32 is used to guide rod 35 of the sharpener stone holder, the post 44 is removed from bore 41, the sharpener 10 is inverted, post 44 is inserted into bore 42, and guide rod 35 is inserted through the proper aperture of guide member 31. At this time guide member 32 is grasped in the same manner as described above relative to guide member 31. The basic procedure is more fully described in copending application Ser. No. 325,758, filed Nov. 30, 1981.

The dimensions of clamp 10 are as follows: Both the clamp members 17 and 18 and the guide members 31 and 32 are approximately one inch wide. The apertures in the guides are approximately one quarter inch long and three sixteenths inches high. The clamp members 17 and 18 are approximately one fourth inch thick at their thickest dimension, and the guide members 31 and 32 are approximately one sixteenth inch thick. The drawings are drawn to scale and the dimensions of the other parts can be obtained from the drawings. It will also be appreciated that the dimensions may vary, as desired.

While preferred embodiments of the present invention have been disclosed, it will be appreciated that the present invention is not limited thereto, but may be otherwise embodied within the scope of the following claims.

What is claimed is:

1. A sharpener clamp construction comprising first and second clamp members having a first longitudinal axis and first and second ends, respectively, first and second jaws at said first ends of said first and second clamp members, respectively, for clamping a knife with a second longitudinal axis extending transversely to said first longitudinal axis, first and second guide member means of substantially the same width as said clamp members formed integrally as an extrusion with and extending outwardly from said first and second clamp members, respectively, at said second end, a plurality of apertures in said first and second guide member means at different distances from said second end for receiving a guide rod attached to a sharpener stone holder, first and second opposite sides on said first and second clamp members, respectively, first and second bores in said first and second opposite sides, respectively, a post, and a pin at the end of said post, said pin being of a size to fit snugly within said first and second bores, whereby said first clamp member may be mounted on said post and thereafter said second clamp member may be mounted on said post after said sharpener body has been inverted relative to said post.

2. A sharpener clamp construction as set forth in claim 1 including a shoulder on said post immediately adjacent said pin to provide a bearing area for said first and second sides.

3. A sharpener clamp construction as set forth in claim 1 wherein said post includes at least one concavely curved portion for receiving the fingers or thumb of a person.

4. A sharpener clamp constructon as set forth in claim 1 wherein said post includes a plurality of concavely curved portions.

5. A sharpener clamp construction as set forth in claim 3 wherein said guide member means and said clamp members are of substantially the same width.

6. A sharpener clamp construction as set forth in claim 3 wherein said clamp members are thicker than said guide members, and curved connection portions joining said clamp members and said guide members.

7. A sharpener clamp construction as set forth in claim 6 including a recess between said curved connection portions for receiving the index finger of a person.

8. A sharpener clamp construction as set forth in claim 1 wherein said post and the guide member to which said post is attached are spaced sufficiently close so that both can be grasped by one hand of a person.

9. A sharpener clamp construction comprising first and second clamp members having a first longitudinal axis and first and second ends, respectively, first and second jaws at said first ends of said first and second clamp members, respectively, for clamping a knife with a second longitudinal axis extending transversely to said first longitudinal axis, first and second guide member means formed integrally with and extending outwardly from said first and second clamp members, respectively, at said second end, a plurality of apertures in said first and second guide member means at different distances from said second end for receiving a guide rod attached to a sharpener stone holder, first and second opposite sides on said first and second clamp members, respectively, first and second bores in said first and second opposite sides, respectively, a post, and a pin at the end of said post, said pin being of a size to fit snugly within said first and second bores, whereby said first clamp member may be mounted on said post and thereafter said second clamp member may be mounted on said post after said sharpener body has been inverted relative to said post.

* * * * *

UNITED STATES PATENT AND TRADEMARK OFFICE

CERTIFICATE OF CORRECTION

PATENT NO. : 4,512,112

DATED : April 23, 1985

INVENTOR(S) : Arthur L. LeVine

It is certified that error appears in the above-identified patent and that said Letters Patent are hereby corrected as shown below:

On the cover page, the disclaimer should read:

--The portion of the term of this patent subsequent to September 18, 2001 has been disclaimed.--

Signed and Sealed this

*Thirty-first* Day of *December 1985*

[SEAL]

*Attest:*

DONALD J. QUIGG

*Attesting Officer*

*Commissioner of Patents and Trademarks*